US007505008B2

(12) United States Patent
Shin et al.

(10) Patent No.: US 7,505,008 B2
(45) Date of Patent: Mar. 17, 2009

(54) ELECTRICAL LOOP ANTENNA WITH UNIDIRECTIONAL AND UNIFORM CURRENT RADIATION SOURCE

(75) Inventors: Chan-Soo Shin, Daejon (KR); Won-Kyu Choi, Daejon (KR); Hae-Won Son, Daejon (KR); Gil-Young Choi, Daejon (KR); Cheol-Sig Pyo, Daejon (KR); Jong-Suk Chae, Daejon (KR); Han-Phil Rhyu, Seoul (KR); Sung-Jun Heo, Seoul (KR); Byung-Je Lee, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 11/526,374

(22) Filed: Sep. 25, 2006

(65) Prior Publication Data

US 2007/0080879 A1 Apr. 12, 2007

(30) Foreign Application Priority Data

Sep. 26, 2005 (KR) ..... 10-2005-0089535
May 3, 2006 (KR) ..... 10-2006-0040102

(51) Int. Cl.
*H01Q 11/12* (2006.01)

(52) U.S. Cl. ..... 343/741; 343/700 MS; 343/866

(58) Field of Classification Search ..... 343/700 MS, 343/741, 742, 866, 867
See application file for complete search history.

(56) References Cited

U.S. PATENT DOCUMENTS 3,967,276 A * 6/1976 Goubau ..... 343/752
4,835,540 A * 5/1989 Haruyama et al. .... 343/700 MS
4,907,006 A * 3/1990 Nishikawa et al. .... 343/700 MS
4,924,237 A * 5/1990 Honda et al. ..... 343/702
6,812,891 B2 * 11/2004 Montgomery et al. . 343/700 MS
6,861,988 B2 * 3/2005 Gabriel et al. ..... 343/700 MS (Continued)

FOREIGN PATENT DOCUMENTS

KR 10-2004-0052869 5/2004

(Continued)

OTHER PUBLICATIONS

"A Study on loop antenna with uniform current distribution." Takashi Minemura et al. ®2004 IEEE. vol. 25, No. 16, Core Technology Center, Toshiba Corp.

*Primary Examiner*—Tho G Phan
(74) *Attorney, Agent, or Firm*—Ladas & Parry LLP

(57) ABSTRACT

Provided is an antenna for a Radio Frequency Identification (RFID) reader using an electrical loop. It includes an upper metal plate which functions as a radiator; a lower metal plate which is disposed apart from the upper metal plate by a predetermined distance and functions as a radiator; a ground plate disposed apart from the lower metal plate by a predetermined distance; and a feeding probe disposed at the center of the upper and lower metal plates. The antenna can perform radiation parallel to the earth's surface including other directions. Therefore, it is suitable for an RFID reader which recognizes an RFID tag attached in parallel to the earth's surface. The electrical loop antenna can control impedance matching, resonance frequency, antenna gain, and radiation pattern according to the distance between metal plates, size of the metal plates, thickness of a feeding probe, and how the metal plates are arranged.

13 Claims, 14 Drawing Sheets

U.S. PATENT DOCUMENTS

| | | | | |
|---|---|---|---|---|
| 2003/0206138 | A1 | 11/2003 | Chiu | |
| 2004/0183742 | A1 | 9/2004 | Goff et al. | |
| 2005/0088342 | A1 | 4/2005 | Parsche | |
| 2005/0162321 | A1* | 7/2005 | Colburn et al. | 343/702 |

FOREIGN PATENT DOCUMENTS

| | | |
|---|---|---|
| WO | WO 2004-051800 | 6/2004 |

* cited by examiner

ELECTRICAL LOOP ANTENNA WITH UNIDIRECTIONAL AND UNIFORM CURRENT RADIATION SOURCE

FIELD OF THE INVENTION

The present invention relates to a Radio Frequency Identification (RFID) antenna using an electrical loop. More particularly, the present invention relates to a unidirectional loop antenna with a uniform current radiation source that has a polarization parallel to the earth's surface and a directivity also parallel to the earth's surface, differently from a typical directional antenna for an RFID reader.

DESCRIPTION OF RELATED ART

Conventional antennas for RFID readers include two antennas using one or two omni-directional or directional feeders to produce dual polarization. On the contrary, the present invention provides an electrical loop antenna having an omni-directional property and a polarization which is level to the earth's surface by using one feeder and a plurality of metal plates. The omni-directional loop antenna may be applied to an RFID reader and used for management of container logistics.

FIG. 1 shows an example of a loop antenna projected on a coordinate system to show a radiation pattern.

Theoretically, a loop antenna 60 has an electric field component in a Φ direction on the coordinate system shown in FIG. 1. In actual physical realization, however, the loop antenna 60 has a current distribution of a ring patch. Thus, the loop antenna 60 has the electric field component in a θ direction on the coordinate system of FIG. 1. This is because the loop antenna comes to have a magnetic resonance characteristic due to the electrical length of the loop or because the electric field including a ground surface directs to the θ direction on an xy plane.

To sum up, an actual loop antenna cannot have an electric component in the Φ direction except a small loop unless it has a unidirectional uniform current radiation source. This is because the resonance characteristic of the loop antenna is dominated by wavelength. Since a small loop does not have a sufficiently long resonance length, small loop cannot be actually realized.

After all, conventional technologies have a limitation in designing a loop antenna for an RFID reader that can smoothly communicate with an RFID tag attached in parallel to the earth's surface.

SUMMARY OF THE INVENTION

It is, therefore, an object of the present invention to provide an electrical loop antenna with a uniform current radiation source which has a polarization parallel to the earth's surface and an omni-directional property including a direction parallel to the earth's surface.

It is another object of the present invention to provide an electrical loop antenna which includes a uniform current radiation source that can feed power easily, compared to a conventional complicated feed structure.

It is another object of the present invention to provide an electrical loop antenna that can control a resonance frequency and an antenna gain by adjusting the gap between metal plates and has a uniform current radiation source, which means that the electrical lengths from a feeder to all open points are all the same.

In accordance with an aspect of the present invention, there is provided an electrical loop antenna with a unidirectional and uniform current radiation source, which includes: an upper metal plate which functions as a radiator; a lower metal plate which is disposed apart from the upper metal plate by a predetermined distance and functions as a radiator; a ground plate which is disposed apart from the lower metal plate by a predetermined distance; and a feeding probe disposed at the center of the upper metal plate and the lower metal plate.

BRIEF DESCRIPTION OF THE DRAWING

The above and other objects and features of the present invention will become apparent from the following description of the preferred embodiments given in conjunction with the accompanying drawings, in which.

DETAILED DESCRIPTION OF THE INVENTION

Other objects and aspects of the invention will become apparent from the following description of the embodiments with reference to the accompanying drawings, which is set forth hereinafter.

Figure 2:
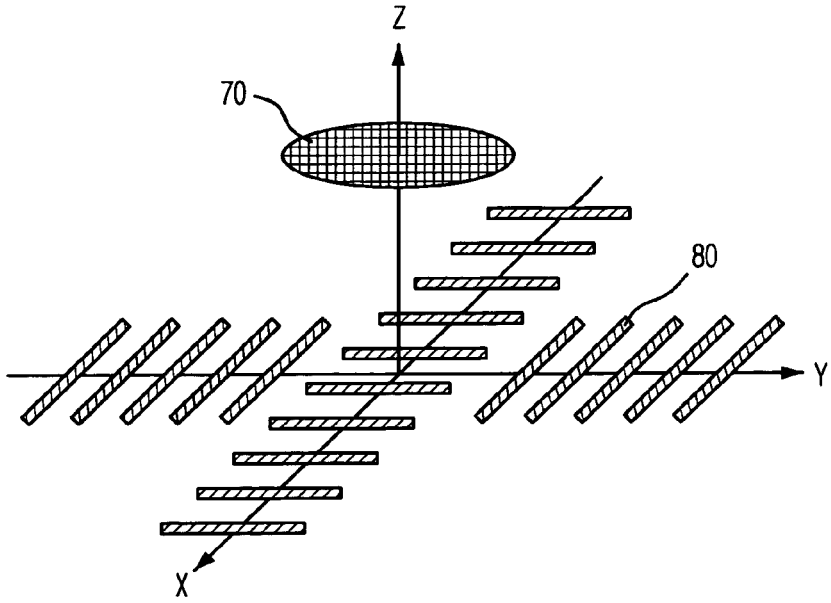
FIG. 2 is a view illustrating a usage environment of an electrical loop antenna in accordance with an embodiment of the present invention.

FIG. 2 is a view illustrating a usage environment of a loop antenna in accordance with an embodiment of the present invention.

Figure 3:
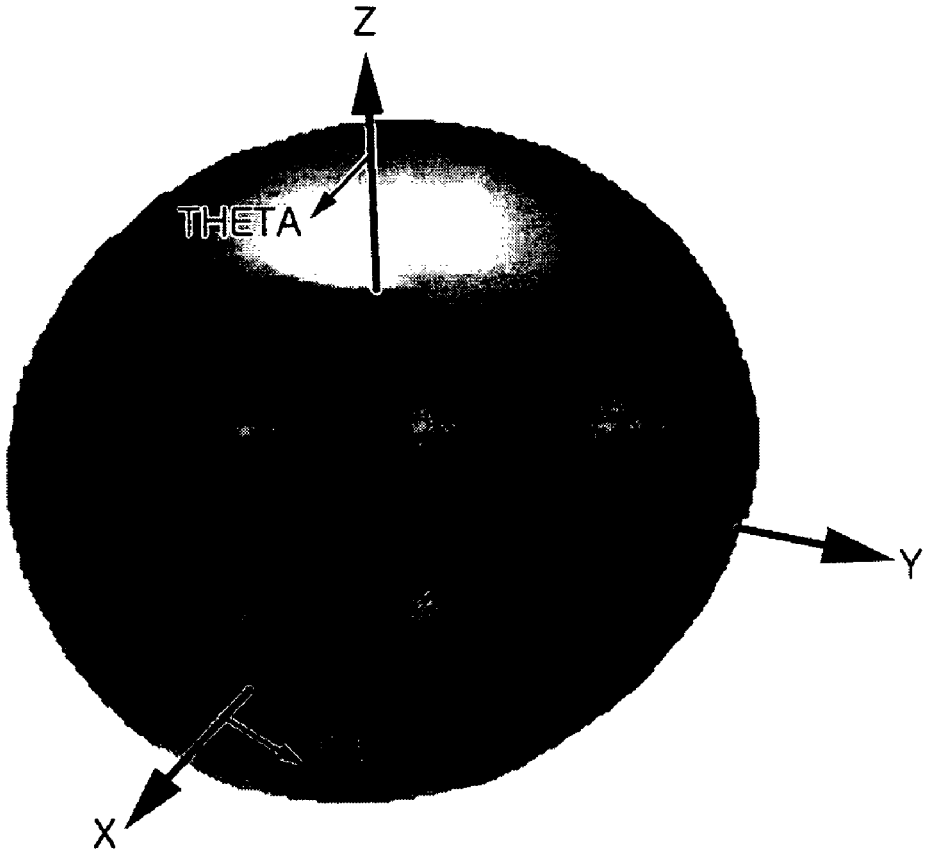
FIG. 3 is a view showing a three-dimensional (3D) radiation pattern of the electrical loop antenna in accordance with an embodiment of the present invention.

Referring to FIG. 2, the loop antenna does not produce a radiation pattern for reading an RFID tag 80 positioned on the side of the loop antenna for an RFID reader, because the loop antenna is too small to reach a space where the RFID tag can be read in an RFID system, for example, an RFID system for management of container logistics. This calls for the development of an antenna for an RFID reader that can smoothly communicate with the RFID tag positioned in parallel to the earth's surface. The radiation pattern requested by the antenna that can communicate with the RFID tag positioned in parallel to the earth's surface is shown in FIG. 3.

Figure 1:
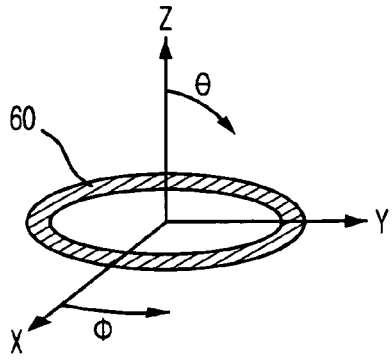
FIG. 1 (RELATED ART)
FIG. 1 is a view showing a loop antenna on a coordinate system.
Figure 4:
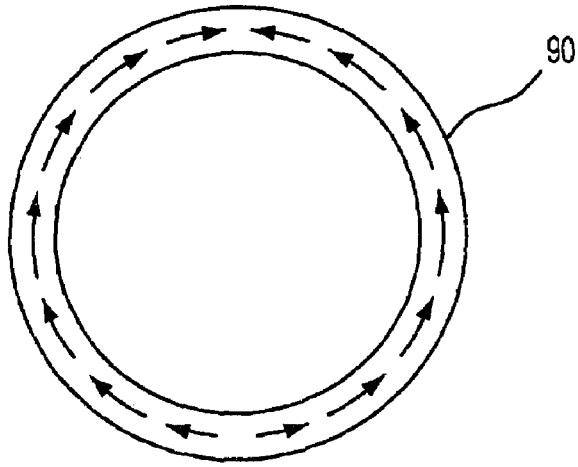
FIG. 4 (PRIOR ART)
FIG. 4 is a view showing a current distribution in a typical loop antenna.

FIG. 4 is a view showing a current distribution of a typical loop antenna 90. Generally, the resonance frequency of a loop antenna is determined based on the length of a half wavelength or the electrical length of a wavelength. The typical type of loop antenna 90 has the current distribution of FIG. 4. Referring to FIG. 4, the loop antenna 90 has a current distribution in the shape of a ring patch and has a θ-directional electric field component as shown in FIG. 1.

However, the loop antenna 90 is not operated as it is supposed to be theoretically. This is because the radiation points of the loop antenna 90 are not arranged in the shape of a loop, actually. In short, the loop antenna 90 cannot form the uniform radiation source in the form of a unidirectional loop.

The present invention discloses a loop antenna having uniform current radiation sources arranged in the shape of a unidirectional loop.

Figure 5:
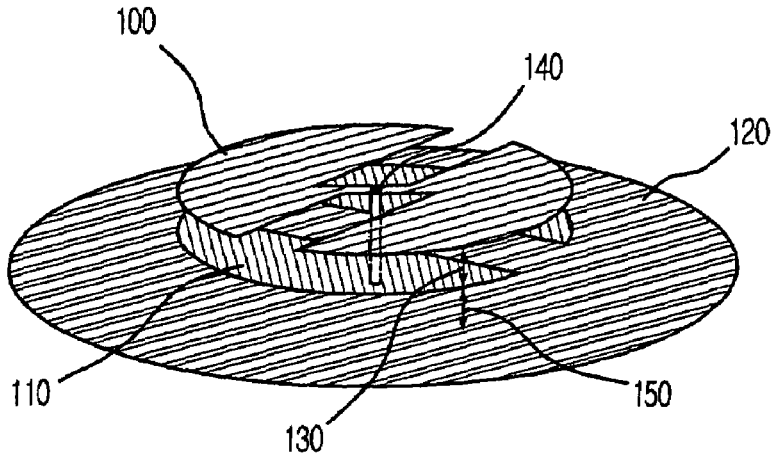
FIG. 5 is a view illustrating an entire structure of a loop antenna in accordance with an embodiment of the present invention.

FIG. 5 is a view illustrating an entire structure of a loop antenna in accordance with an embodiment of the present invention.

The loop antenna of the present invention includes an upper metal plate 100, a lower metal plate 110 disposed apart from the upper metal plate 100 by a predetermined distance, a ground plate 120 disposed apart from the lower metal plate 110 by a predetermined distance, and a feeding probe 140 disposed at the center of the upper and lower metal plates 100 and 110.

The entire structure of the loop antenna is circular when it is seen from the top. The two metal plates that function as radiators, i.e., the upper and lower metal plates 100 and 110, are arranged perpendicularly to each other. The lowest metal plate is the ground plate 120, which is of a perfect circle. The upper metal plate 100 is apart from the lower metal plate 110 by a predetermined distance 130. The feeding probe 140 is disposed at the center of the metal plates to electrically feed the two metal plates 100 and 110 simultaneously.

FIG. 5 also shows the upper metal plate 100 and the lower metal plate 110. The two metal plates 100 and 110 are apart from the ground plate 120 by a non-electrical supporter (not shown) by a predetermined distance 150 in the form of a stack.

The electrical lengths from the center of the upper and lower metal plates 100 and 110, where power feeding is performed practically, to all open points are the same. Thus, the intensity of current at the open points where radiation actually occurs are all the same. Also, since the upper and lower metal plates 100 and 110 are positioned adjacently and perpendicularly to each other, it is possible to refrain the current intensity from changing and make the current flow in one direction.

Figure 6A:
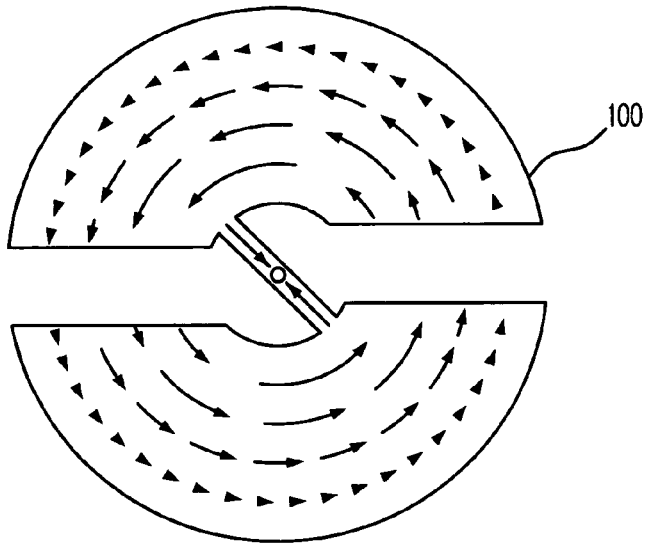
FIGS. 6A to 6C are views describing current distributions of the loop antenna of FIG. 5.
Figure 6B:
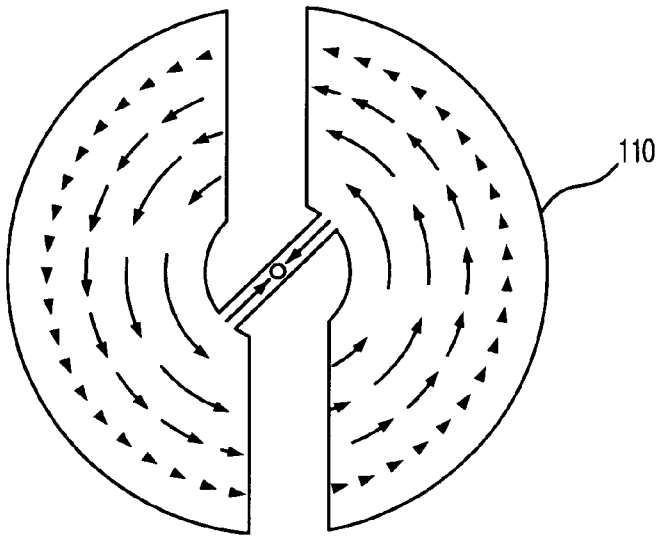
Figure 6C:
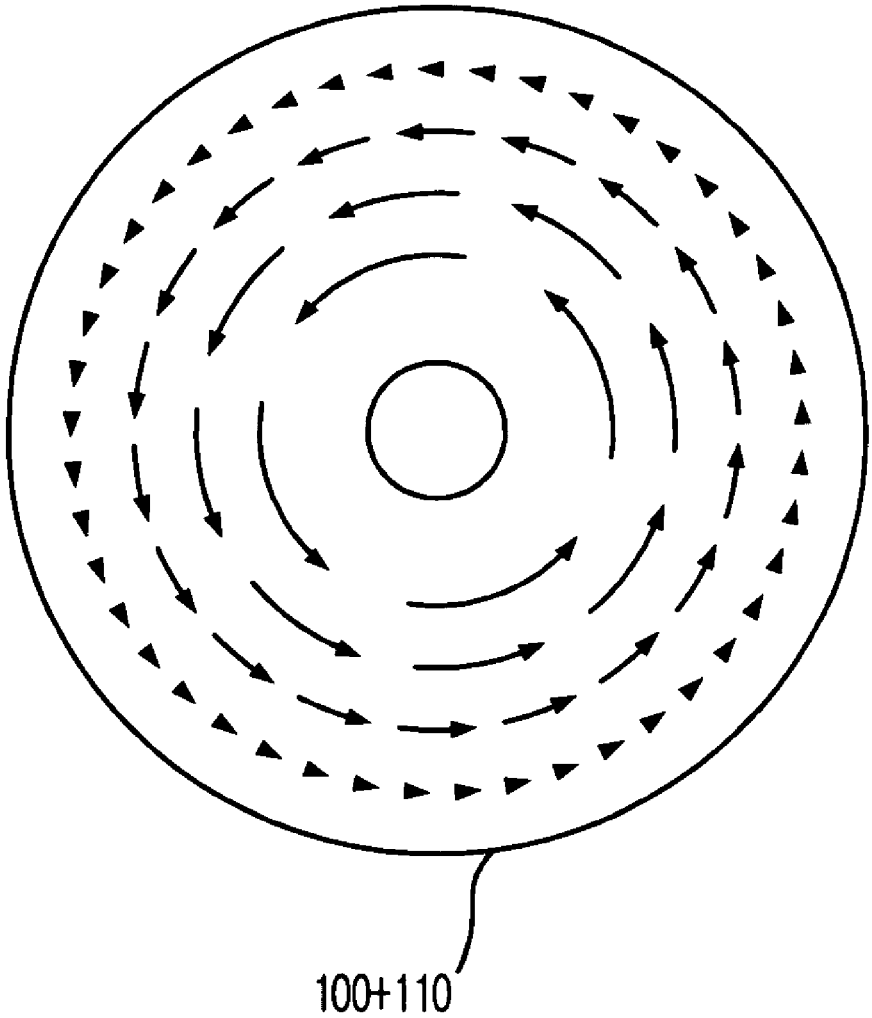

FIGS. 6A to 6C are views describing current distributions of the loop antenna of FIG. 5. FIG. 6A shows current distribution of the upper metal plate 100, and FIG. 6B shows current distribution of the lower metal plate 110. FIG. 6C shows current distribution of the entire loop antenna including the upper and lower metal plates 100 and 110. Thus, the current of the loop antenna illustrated in FIG. 5 has only a Φ-directional component in the coordinate system of FIG. 1, and the polarization of the loop antenna, too, has the same component, i.e., a Φ-directional component. Therefore, the loop antenna can read an RFID tag having a Φ-directional polarization, which is level with the earth's surface apart from the x axis or the y axis in the coordinate system of FIG. 1.

Figure 7A:
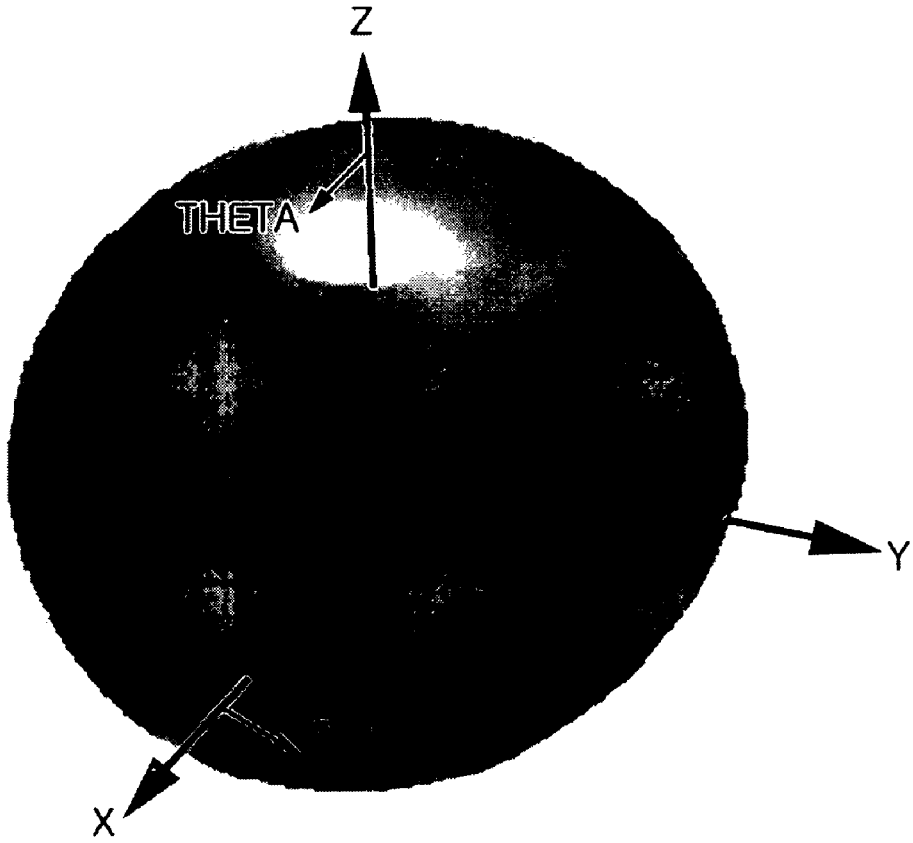
FIGS. 7A to 7D are views depicting a radiation pattern of the loop antenna of FIG. 5.
Figure 7B:
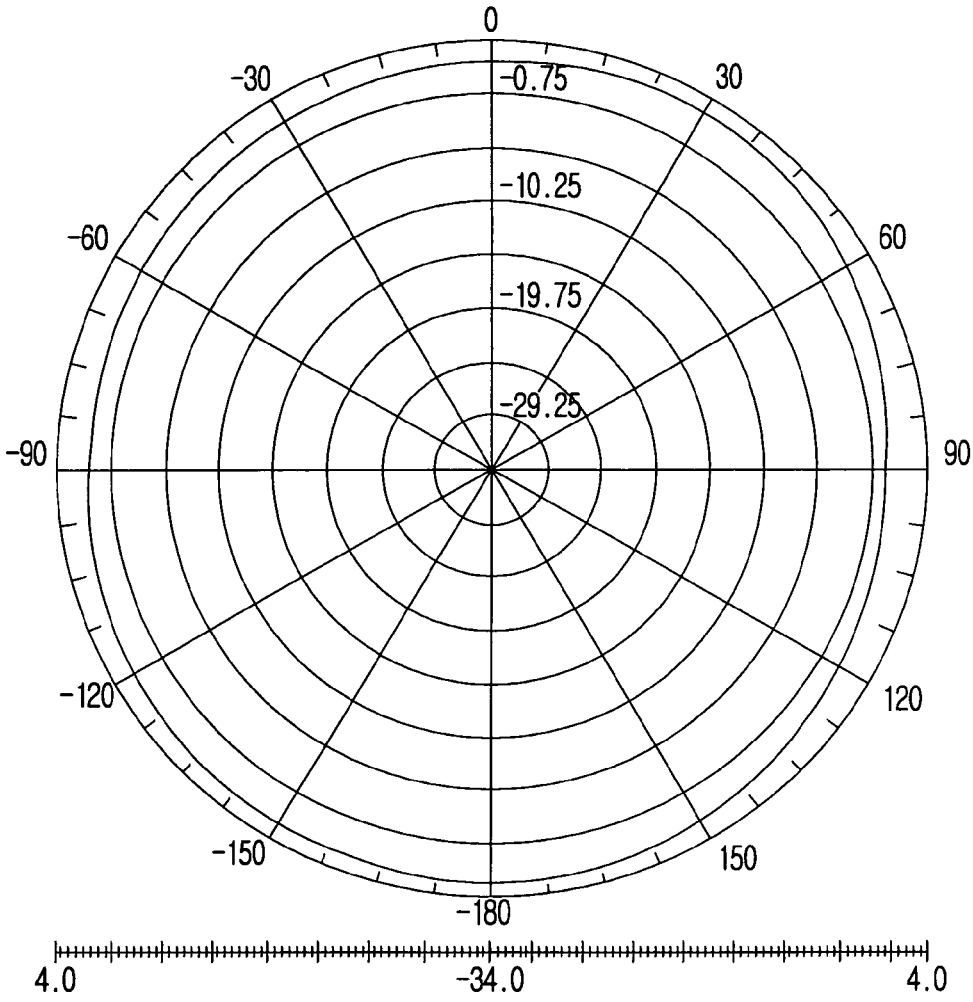
Figure 7C:
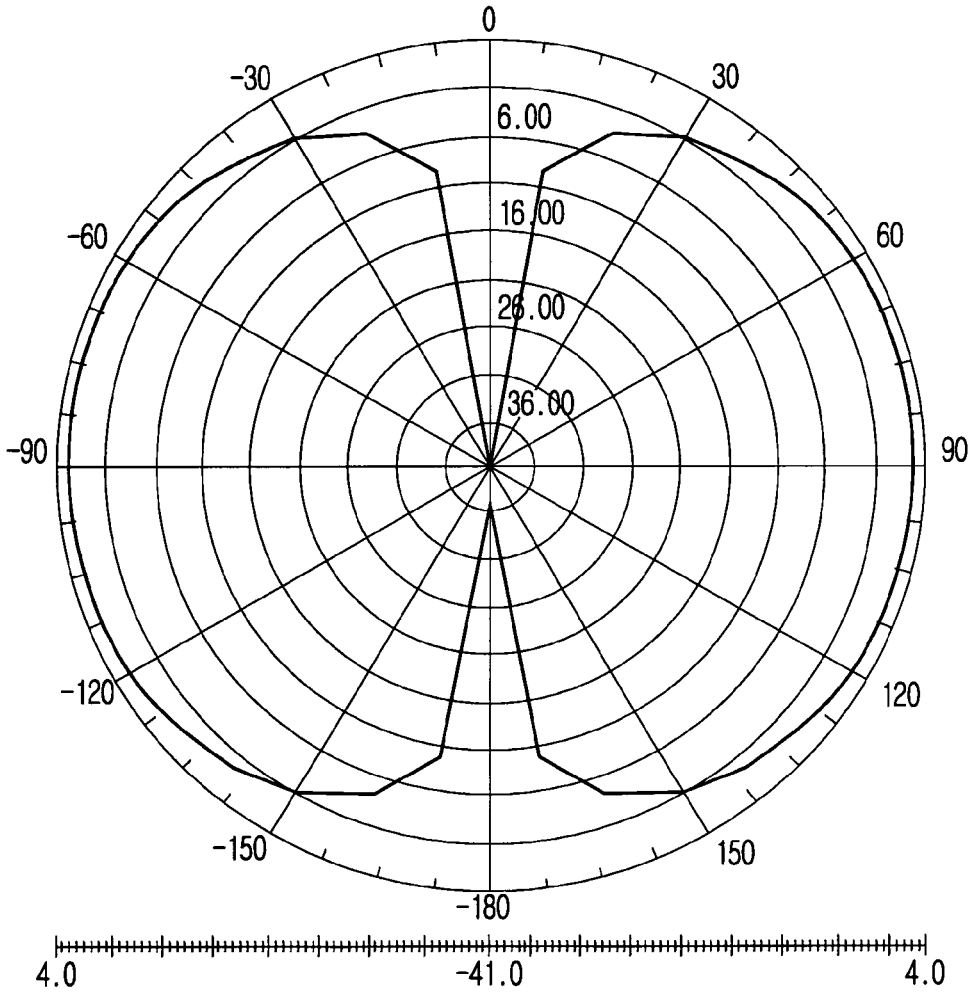
Figure 7D:
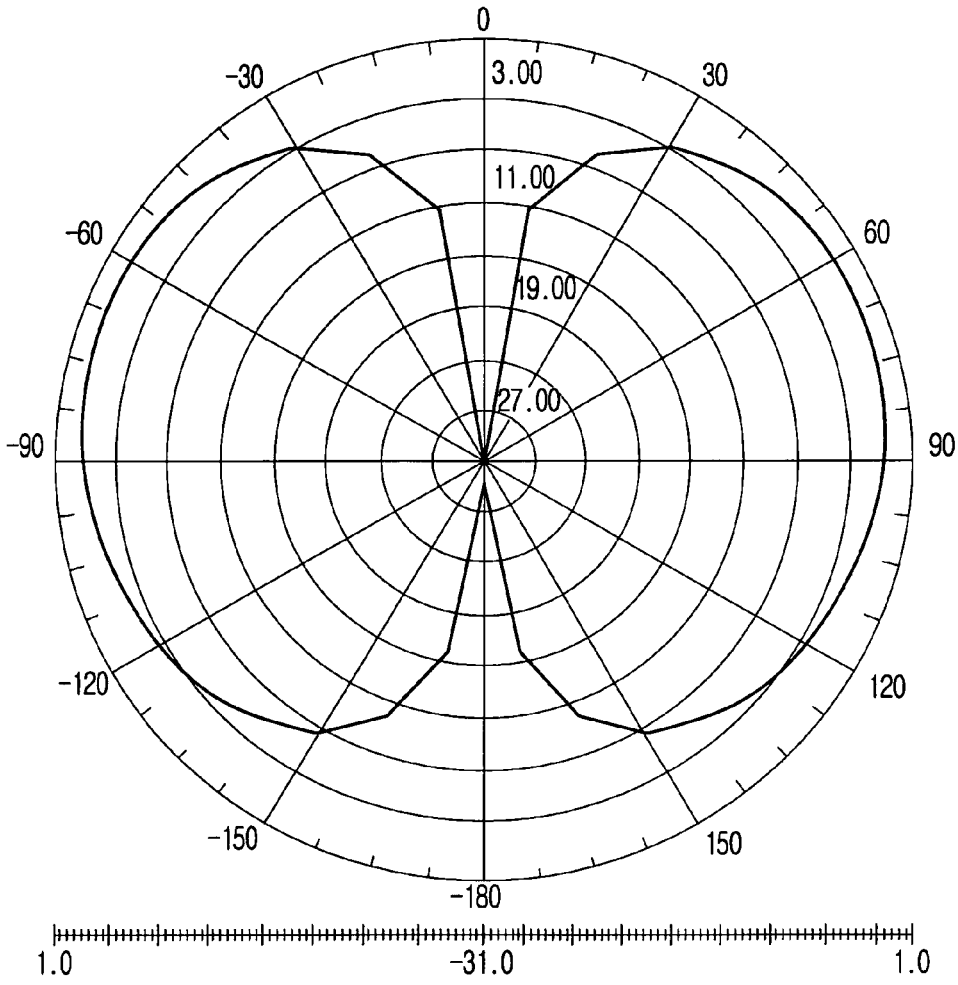
Figure 8:
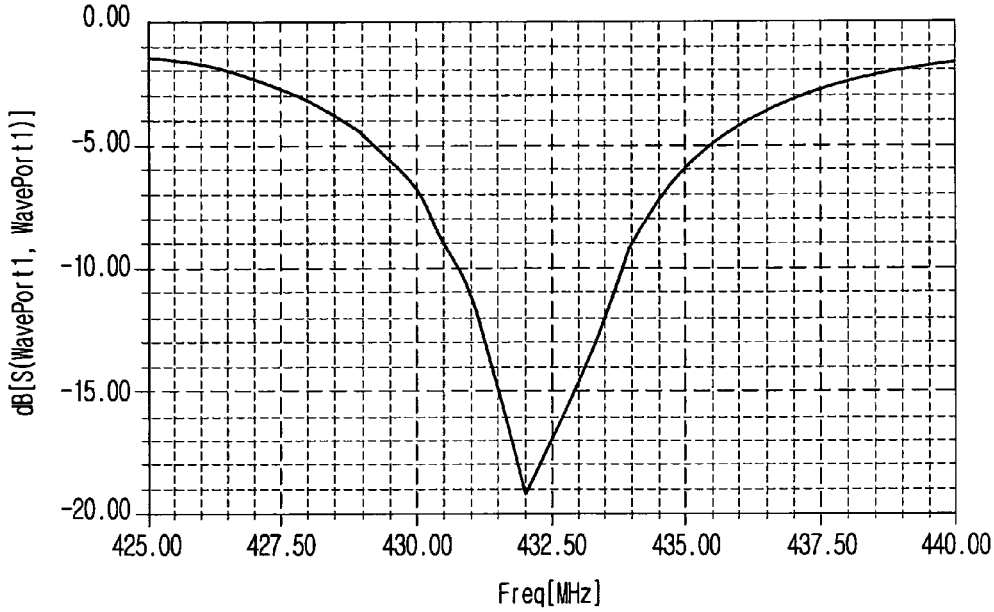
FIG. 8 is a graph showing a resonance characteristic of the loop antenna shown in FIG. 5.

FIG. 7A shows a Φ-field radiation pattern of the loop antenna shown in FIG. 5 on a three-dimensional system, and FIG. 7B shows a Φ-field radiation pattern on an xy plane when θ=90°. FIG. 7C shows a Φ-field radiation pattern on an xz plane when θ=90°, and FIG. 7D shows a Φ-field radiation pattern on a yz plane when Φ=90°. FIG. 8 shows a resonance characteristic of the loop antenna shown in FIG. 5.

Referring to FIGS. 7A to 7C and 8, the radiation patterns and resonance characteristics of the loop antenna suggested in the present invention are the same as theoretic analysis of the loop antenna. A general loop antenna can hardly acquire the resonance characteristic and radiation pattern. Therefore, the antenna of the present invention is referred to an electrical loop antenna, herein, to be differentiated from general loop antenna which is realized physically.

Figure 9:
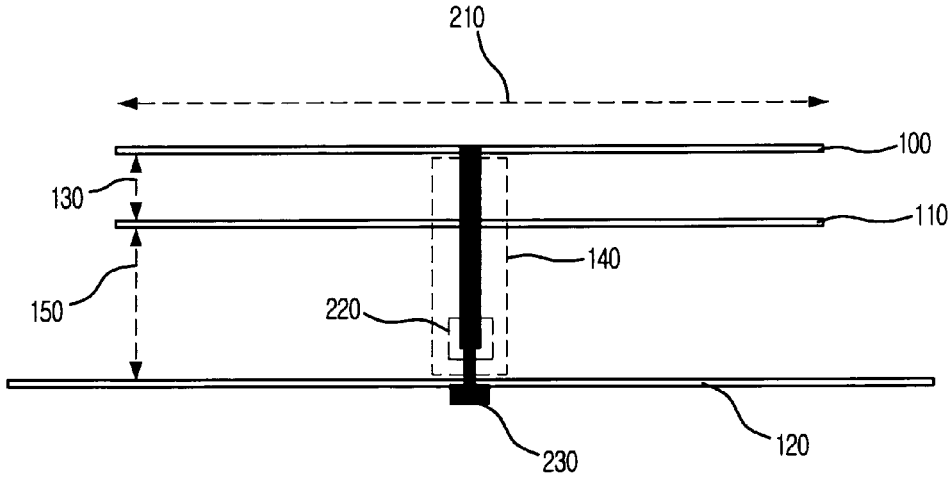
FIG. 9 is a side view illustrating a part that involves in the characteristic change of the loop antenna shown in FIG. 5.

FIG. 9 is a side view showing a part that involves in characteristic change of the loop antenna shown in FIG. 5. The resonance frequency and antenna gain are changed according to the gap 130 between the upper metal plate 100 and the lower metal plate 110. The narrower the gap 130 is, the lower the resonance frequency becomes and the higher the antenna gain becomes. This is because the electric distance from an actual feeder to open points of the two metal plates where final radiation is performed becomes shorter.

Figure 10:
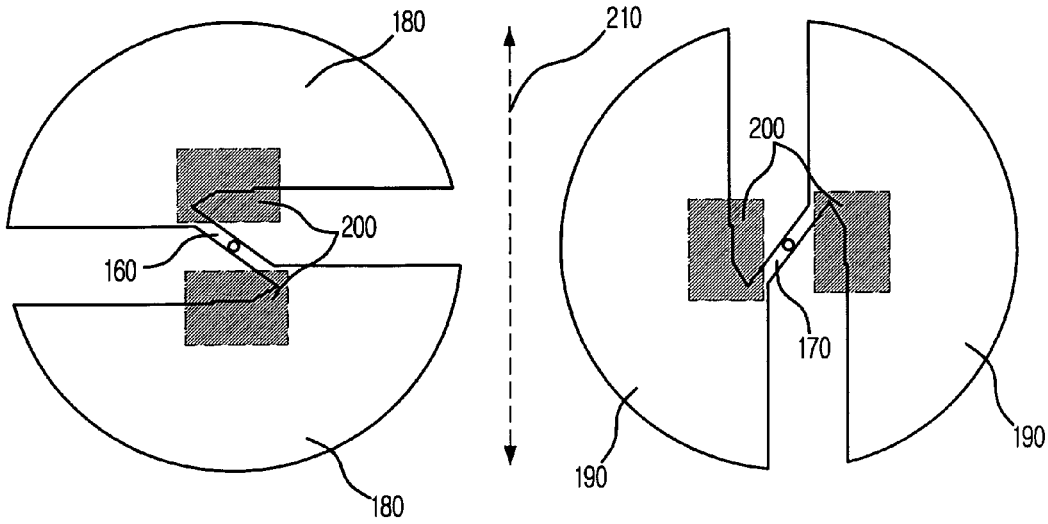
FIG. 10 is a top view showing metal plates of the loop antenna.

FIG. 10 shows structures of the metal plates. The antenna can adjust the resonance frequency based on the area of the space 200 between the thin metal unit 160 and 170 and the thick metal unit 180 and 190 in each metal plate. When the space 200 is blocked with a metal substance, the resonance frequency increases. When the space 200 is open, the resonance frequency decreases. In addition, the resonance frequency may increase by reducing a diameter 210, which is the entire size of the metal plate stack of the loop antenna. When the diameter 210 is increased, the resonance frequency can be decreased. The extent of matching among resonance characteristics of the antenna mainly depend on the thickness and the thickness change 220 of the thin metal pieces 160 and 170 disposed in the center of the metal plates 100 and 110 and the feeding probe 140, and on the thickness change 220 thereof. When the resonance frequency of the antenna is changed, the matching extent may be lowered. In this case, the matching extent can be recovered to the higher level by properly controlling the thickness of the thin metal pieces 160 and 170 and the feeding probe 140, and the thickness change 220 thereof.

Therefore, the loop antenna of the present invention provides excellent performance and it can be applied to other systems which require the above-described radiation pattern.

Figure 11:
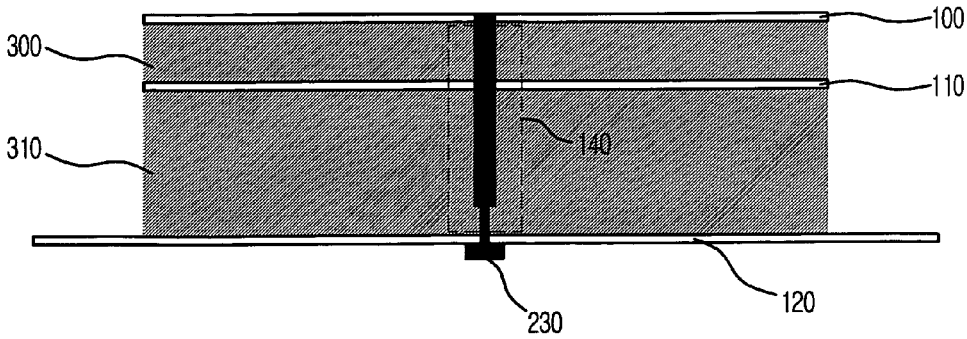
FIG. 11 is a side view illustrating a variable antenna.

Although the space between the metal plates 100 and 110 and the ground plate 120 is filled with air in the above-described embodiment, dielectric layers 300 and 310 may be disposed in the space to increase the electrical length and decrease the physical length in another embodiment shown in FIG. 11. The dielectric layers may be disposed only in the current open points having a uniform and minimum unidirectional loop current source, in which radiation is actually carried out.

Figure 12:
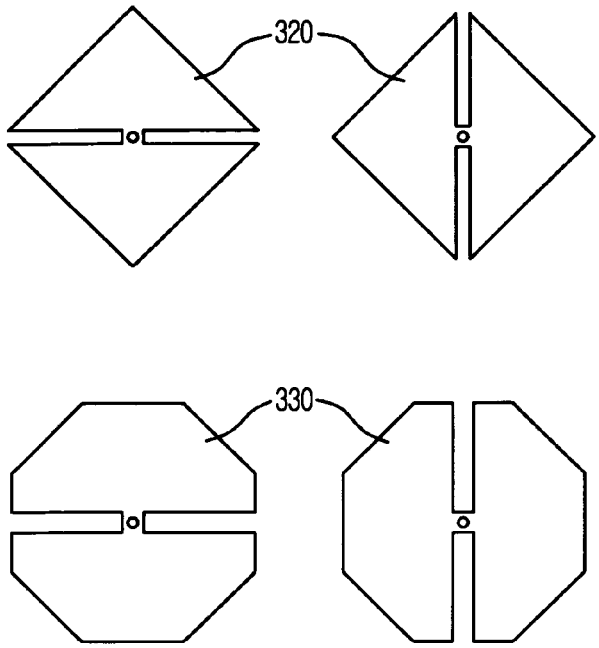
FIG. 12 shows examples of polygonal loop antenna in accordance with an embodiment of the present invention.

Also, as shown in FIG. 12, the loop antenna may have a polygonal shape including slots formed therein, instead of a round shape to match the resonance length of the entire radiation currents.

Figure 13A:
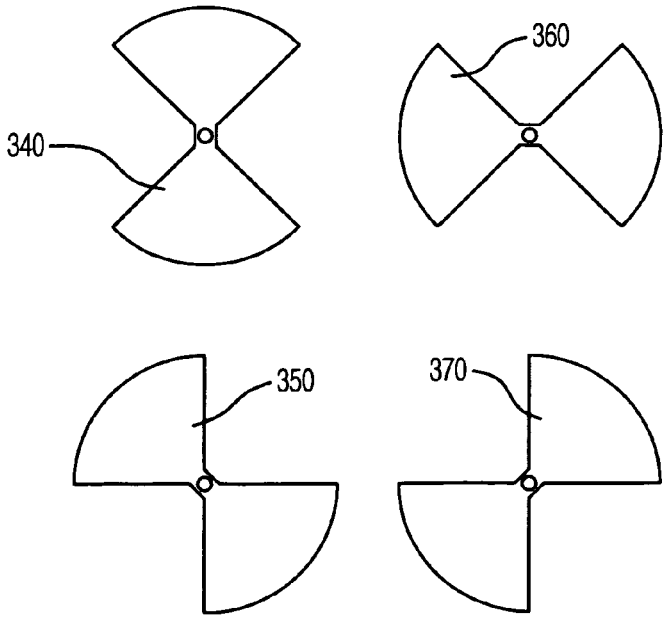
FIGS. 13*a* to 13*b* show metal plates arranged at an angle smaller than 90°.
Figure 13B:
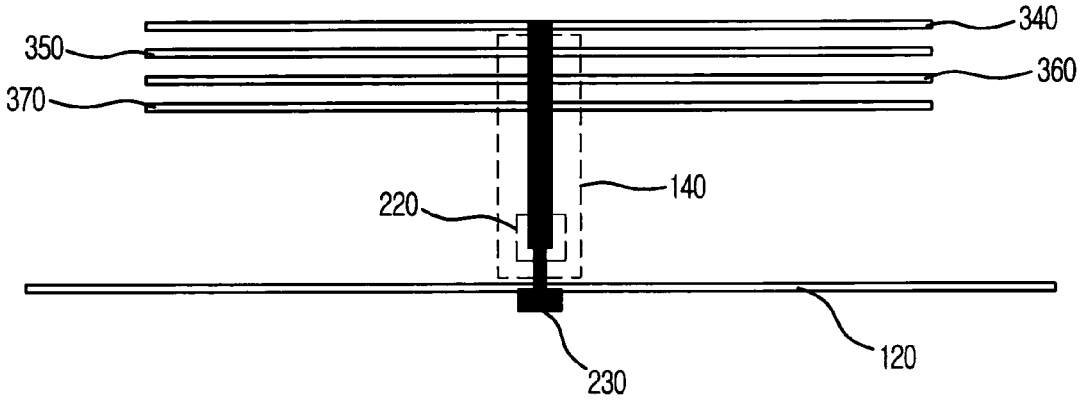
Figure 14:
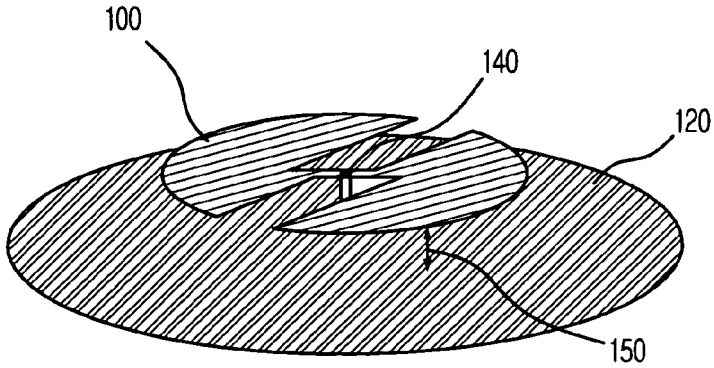
FIG. 14 is an exemplary view showing an electrical loop antenna including one metal plate and a ground plate in accordance with an embodiment of the present invention.

Also, as shown in FIGS. 13*a* and 13*b*, the loop antenna may be realized in multiple layers 340, 350, 360 and 370 arranged at an angle smaller than 90°.

The antenna may be realized to include the ground plate 120 and one metal plate 100 disposed on the ground plate 120. The antenna, however, presents a little distortion in a radiation pattern because a part of the electrical loop is cut by a slot.

Figure 15:
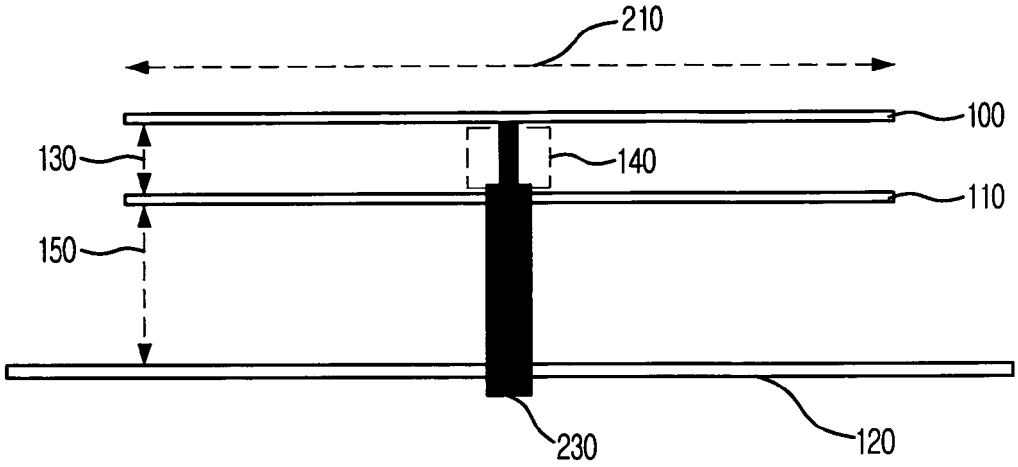
FIG. 15 is an exemplary view showing an electrical loop antenna including two metal plate receiving different currents in accordance with an embodiment of the present invention.

Also, as shown in FIG. 15, when different currents are supplied to two metal plates 100 and 110 in an antenna, the similar effect can be obtained. In the antenna, the lower metal plate 110 is electrically connected to an external conductor 230 of the feeding probe 140, and the upper metal plate 100 is electrically connected to the feeding probe 140. Since the polarization of the antenna attracts opposite charges, the antenna comes to have Φ-directional field component rather than the θ-directional field component. The antenna, however, shows inferior performance in controlling impedance matching and resonance frequency and acquires relatively less gain.

The present application contains subject matter related to Korean patent application No. 2005-0089535 and 2006-0040102, filed with the Korean Intellectual Property Office on Sep. 26, 2005, and May 3, 2006, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A electrical loop antenna with a unidirectional and uniform current radiation source, comprising:

an upper metal plate;

a lower metal plate disposed parallel to the upper metal plate by a predetermined distance therebetween, wherein each of the upper and lower metal plates comprises two metal pieces connected to each other by a connecting metal piece smaller in size than each of the two metal pieces, and wherein the lower and upper plates function as a radiator;

a ground plate disposed parallel to the lower metal plate by a predetermined distance; and a feeding probe disposed to connect at least the centers of the upper metal plate and the lower metal plate.

2. The electrical loop antenna as recited in claim 1, wherein the upper and lower metal plates are disposed to have a predetermined part of the upper and lower metal plates overlapped with each other to supply a continuous radiation current, when the upper and lower metal plates are seen from the top.

3. The electrical loop antenna as recited in claim 1, wherein the upper and lower metal plates are identical in shape.

4. The electrical loop antenna as recited in claim 3, wherein the upper and lower metal plates having the identical shape are oriented perpendicular to each other when viewed perpendicular to the parallel planes on which the upper and lower metal planes are disposed respectively.

5. The electrical loop antenna as recited in claim 1, wherein the upper and lower metal plates have uniform distance from a feeding point to open points, which are radiation source.

6. The electrical loop antenna as recited in claim 5, wherein the electrical loop antenna produces radiation current at a uniform level by making the distance from the feeding point to the open points.

7. The electrical loop antenna as recited in claim 1, further comprising:

dielectric layer between the upper metal plate and the lower metal plate and between the lower metal plate and the ground plate.

8. The electrical loop antenna as recited in claim 1, wherein an external conductor of the feeding probe is electrically connected to the lower metal plate at the center, and a central conductor of the feeding probe is electrically connected to the upper metal plate at the center.

9. The electrical loop antenna as recited in claim 1, wherein the upper and lower metal plates have a regular polygonal shape.

10. An electrical loop antenna with a unidirectional and uniform current radiation source, comprising:

a radiation unit comprising a plurality of metal plates parallelly arranged with a gap between any two metal plates, wherein each metal plate comprises two metal pieces connected to each other by a connecting metal piece smaller in size than each of the two metal pieces;

a feeding probe connected to the center of the radiation unit and feeding the multiple metal plates simultaneously; and a ground plate disposed parallel to the radiation unit with a gap therebetween.

11. The electrical loop antenna as recited in claim 10, wherein the parallel metal plates are oriented to have predetermined parts of the metal plates overlapped with each other when viewed perpendicular to the surfaces of the parallel metal plates to supply a continuous radiation current.

12. The electrical loop antenna as recited in claim 10, wherein the metal plates of the radiation unit have a uniform distance from a feeding point to open points, which are radiation source.

13. The electrical loop antenna as recited in claim 10, wherein the metal plates have a regular polygonal shape.

* * * * *